US010997883B2

(12) United States Patent
Kang et al.

(10) Patent No.: US 10,997,883 B2
(45) Date of Patent: May 4, 2021

(54) DISPLAY PANEL CRACK DETECTOR, DISPLAY DEVICE, AND METHOD FOR DRIVING DISPLAY DEVICE

(71) Applicant: SAMSUNG DISPLAY CO., LTD., Yongin-si (KR)

(72) Inventors: Da Eun Kang, Yongin-si (KR); Jae Woo Ryu, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/408,595

(22) Filed: May 10, 2019

(65) Prior Publication Data

US 2020/0111395 A1 Apr. 9, 2020

(30) Foreign Application Priority Data

Oct. 5, 2018 (KR) ..... 10-2018-0119235

(51) Int. Cl.
*G09G 3/00* (2006.01)
*G09G 3/3225* (2016.01)
*G09G 3/3275* (2016.01)

(52) U.S. Cl.
CPC ..... *G09G 3/006* (2013.01); *G09G 3/3225* (2013.01); *G09G 3/3275* (2013.01)

(58) Field of Classification Search
CPC ..... G09G 3/006; G09G 3/3275; G09G 3/3225
See application file for complete search history.

(56) References Cited

U.S. PATENT DOCUMENTS

2014/0176844 A1* 6/2014 Yanagisawa ..... G02F 1/1309 349/43
2016/0043010 A1* 2/2016 Kwak ..... H01L 27/3276 257/48
2017/0069239 A1* 3/2017 Kwon ..... G09G 3/006
2017/0192065 A1 7/2017 Lee et al.
2019/0340966 A1* 11/2019 Lee ..... G09G 3/3677
2020/0066196 A1* 2/2020 Hao ..... G09G 3/006

FOREIGN PATENT DOCUMENTS

KR 10-2017-0080764 7/2017
KR 10-2018-0051910 * 5/2018

* cited by examiner

*Primary Examiner* — Amit Chatly
(74) *Attorney, Agent, or Firm* — F. Chau & Associates, LLC

(57) ABSTRACT

A crack detector may include a plurality of crack detection switches for connecting and disconnecting data lines of a display panel to one another. A signal supply may supply a detection control signal for controlling opening/closing of the crack detection switches and supply a crack detection signal to a first data line. A crack determiner may be configured to determine a crack of the display panel by comparing an output signal supplied from a second data line connected to the first data line through one of the crack detection switches, with a preset reference value.

19 Claims, 6 Drawing Sheets

DISPLAY PANEL CRACK DETECTOR, DISPLAY DEVICE, AND METHOD FOR DRIVING DISPLAY DEVICE

CROSS-REFERENCE TO RELATED APPLICATION

The present application claims priority under 35 U.S.C. § 119(a) to Korean patent application 10-2018-0119235 filed on Oct. 5, 2018 in the Korean Intellectual Property Office, the entire disclosure of which is incorporated herein by reference.

1. TECHNICAL FIELD

The present disclosure generally relates to display devices and more particularly to a display panel crack detector, a display device including the same, and a method for driving the display device.

2. DISCUSSION OF RELATED ART

Pixels included in a display device emit light with a predetermined luminance, based on the magnitudes of data voltages supplied from a data driver. The data voltages are supplied to the pixels through a plurality of data lines.

Meanwhile, as the resolution of recent display devices has increased, so has the degree of integration of the pixels within a display panel of the display device. Accordingly, various conductive lines and patterns are concentrated in a narrow space, and therefore any crack in the display panel may adversely affect performance and cause a defect. Thus, it is desirable to detect whether any cracks are present.

SUMMARY

Embodiments provide a crack detector for detecting a crack of a display panel, using a current or voltage supplied to data lines.

Embodiments also provide a display device including the crack detector, and methods for driving the display device.

According to an aspect of the present disclosure, a crack detector may include a plurality of crack detection switches for connecting and disconnecting data lines of a display panel to one another. A signal supply may be configured to supply a detection control signal for controlling opening/closing of the crack detection switches and to supply a crack detection signal to a first data line of the data lines. A crack determiner may be configured to detect a crack of the display panel by comparing an output signal supplied from a second data line of the data lines connected to the first data line through one of the crack detection switches, with a preset reference value.

Each of the crack detection switches may electrically connect two different data lines.

Each of the crack detection switches may be connected to far ends of two data lines adjacent to each other.

The crack detection switches may be substantially simultaneously turned on.

The crack detection signal may correspond to a preset test voltage. The reference value may correspond to a range obtained by applying a preset voltage drop offset to the test voltage.

The crack determiner may output crack data when the output signal is beyond a threshold corresponding to the reference value.

The crack detection signal may correspond to a preset test current. The reference value may correspond to a preset line resistance range.

The crack determiner may output crack data when a resistance value calculated from the output signal is outside the line resistance range.

According to another aspect of the present disclosure, there is provided a display device including: a display panel including a plurality of pixels connected to a plurality of scan lines and a plurality of data lines; a scan driver configured to supply a scan signal to each of the scan lines; a data driver configured to supply a data signal to each of the data lines; and a crack detector configured to detect a crack of the display panel, based on a crack detection signal supplied to the data lines. The crack detector may include: a plurality of crack detection switches for connecting/disconnecting data lines to one another; a signal supply configured to supply a detection control signal for controlling closing/opening of the crack detection switches; and a crack determiner configured to determine a crack of the display panel by comparing an output signal supplied from the data lines with a preset reference value.

Each of the crack detection switches may be connected to far ends of two data lines adjacent to each other at one side of the display panel.

The number of the crack detection switches may be one half of the number of the data lines.

The crack detection switches may be turned on in a crack detection period included in a vertical blank period.

The crack detection switches may be substantially simultaneously turned on during an interval in the range of 1 H to 2 H periods.

The data lines may include: input data lines connected to the signal supply to receive a crack detection signal for crack detection; and output data lines connected to the crack determiner to provide the output signal to the crack determiner.

The crack detection switches may respectively connect the input data lines to the output data lines.

The input data lines and the output data lines may be connected to the data driver in a display period, and be connected to the crack detector in a vertical blank period.

The data driver may output a crack detection signal for crack detection in a partial period of the vertical blank period.

The data lines may include: input data lines connected to the data driver, the input data lines receiving the data voltage in the display period, the input data lines receiving the crack detection signal in the vertical blank period; and output data lines connected to the data driver in the display period to receive the data voltage, and connected to the crack determiner in the vertical blank period to provide the output signal to the crack determiner.

According to still another aspect of the present disclosure, there is provided a method for driving a display device, the method including: closing a crack detection switch to thereby electrically connect an input data line and an output data line, during a crack detection period included in a vertical blank period; when the input and output data lines are electrically connected, supplying a crack detection signal to the input data line and receiving an output signal supplied from the output data line; if a level of the output signal is within a preset range, displaying an image of a next frame; and if the level of the output signal is outside the preset range, outputting crack data indicative of a crack affecting the input and output data lines.

A crack sensing image may be output in response to the crack data.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

DETAILED DESCRIPTION

Figure 1:
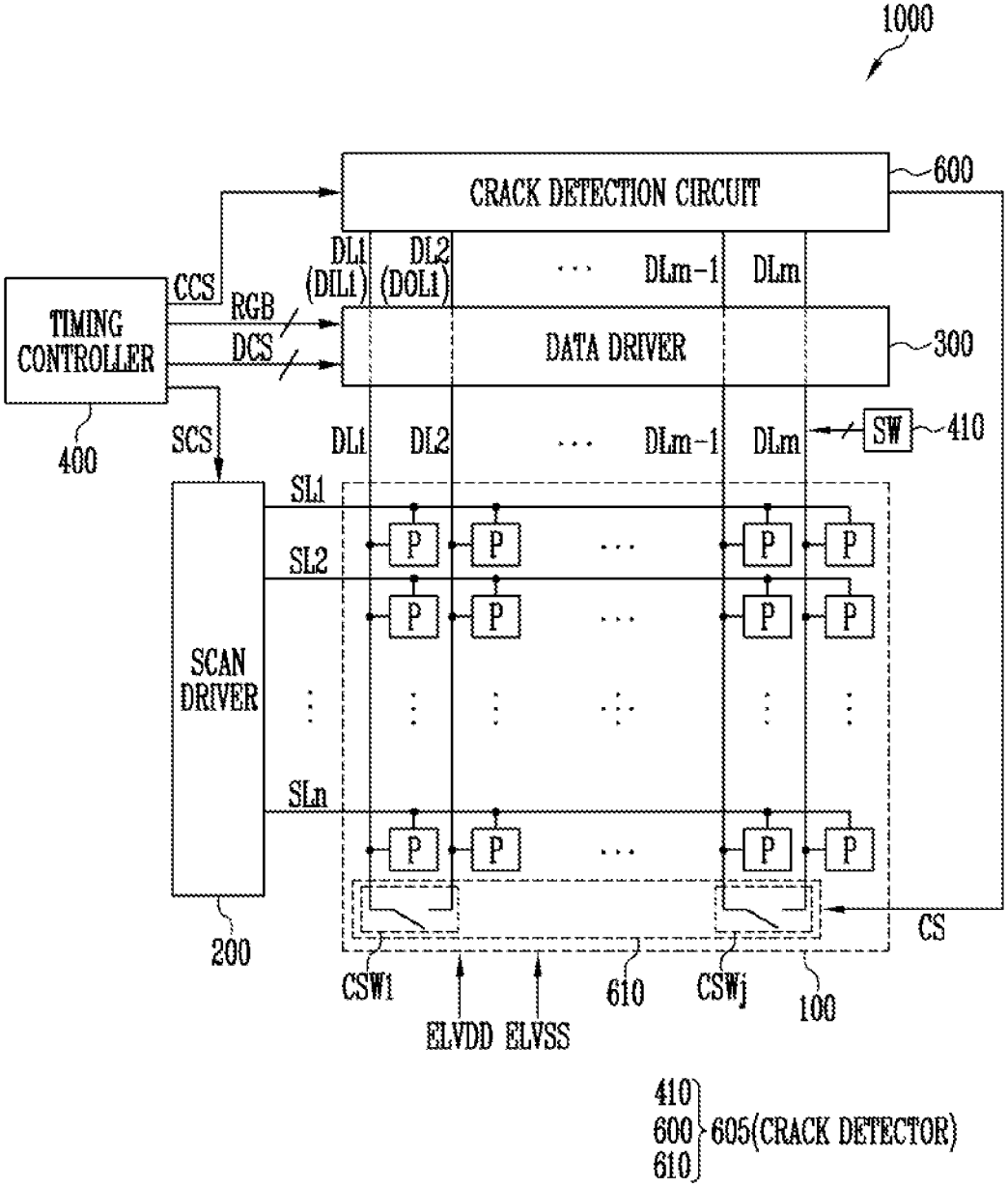
FIG. 1 is a diagram illustrating a display device according to an embodiment of the present disclosure.

Hereinafter, exemplary embodiments of the present disclosure will be described in more detail with reference to the accompanying drawings. In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

FIG. 1 is a diagram illustrating a display device, 1000, according to an embodiment of the present disclosure. Display device 1000 may include a display panel 100, a scan driver 200, a data driver 300, a timing controller 400, and a crack detector 605. Crack detector 605 may include a crack detection circuit 600, a switch set 610 and output signal switches 410.

The display device 1000 may be implemented with an organic light emitting display device, a liquid crystal display device or the like. The display device 1000 may be a flat panel display device, a flexible display device, a curved display device, a foldable display device, or a bendable display device. Also, the display device 1000 may be applied to a transparent display device, a head-mounted display device, a wearable display device, and the like.

The display panel 100 may include a plurality of scan lines SL1 to SLn, a plurality of data lines DL1 to DLm, and a plurality of pixels P connected to portions at which the scan lines SL1 to SLn and the data lines DL1 to DLm intersect each other (n and m are integers larger than 1). The switch set 610 may be integrated with display panel 100 as shown, or may be located elsewhere in display device 1000.

The scan driver 200, the data driver 300, and the timing controller 400, while shown separate from display panel 100, may be disposed in a peripheral area at the periphery of the display panel 100.

The scan driver 200 may apply a scan signal to the scan lines SL1 to SLn, based on a scan control signal SCS provided from the timing controller 400. In an embodiment, the scan driver 200 may be integrated on the peripheral area of the display panel 100, or be mounted in the form of a driving chip on the peripheral area of the display panel 100.

The data driver 300 may apply respective data voltages to the data lines DL1 to DLm, based on a data control signal DCS and image data RGB, which are provided from the timing controller 400. The data driver 300 may be integrated in a driving chip attached (mounted) in the peripheral area of the display panel 100, or may be disposed directly on the peripheral area of the display panel 100.

In an embodiment, the data driver 300 may supply data voltages corresponding to the image data RGB to the respective data lines DL1 to DLm in a display period, and supply a predetermined test voltage corresponding to a crack detection signal to some, but not all, of the data lines DL1 to DLm in a vertical blank period. Hereafter, any data line DLi that receives the test voltage may be referred to as an input data line DILi and any data line that outputs an output signal derived from this test voltage may be referred to as an output data line DOLi (where "i" is any integer between 1 and m).

The crack detector 605 may detect whether a crack of the display panel 100 has occurred, based on the crack detection signal supplied to some of the data lines DL1 to DLm. The crack detector 600 may detect whether a crack has occurred and a position at which the crack has occurred. In an embodiment, as discussed later, the position at which the crack has occurred may be determined through control of the output signal switches 410, which may be connected to respective output data lines DOL.

The crack detector 605 may perform a crack detection operation, based on a detector control signal CCS provided from the timing controller 400. In an embodiment, the crack detector 605 may perform the crack detection operation for a short time interval during a vertical blank period between display periods. For example, the crack detection operation may be performed during an interval that may be in a range of about 1 H to about 2 H in the vertical blank period, where H is a horizontal period currently used by display device 1000 for displaying a line of a frame.

The switch set 610 may including a plurality of crack detection switches CSW for respectively connecting between the data lines DL1 to DLm. For instance, a first crack detection switch CSW1, when controlled to close/open, may electrically connect/disconnect adjacent data lines DL1 (input data line DIL1) and DL2 (output data line DOL1) to one another. (Hereafter, either of the labels "CSW" or "CSWi" may refer to any crack detection switch within the switch set 610, where "i" is any integer.)

The crack detection circuit 600 may include a signal supply (e.g. 620 of FIG. 3) that supplies a detection control signal CS for controlling on/off of the crack detection switches, and a crack determiner (e.g. 640 of FIG. 3) that detects and/or determines a crack of the display panel 100 by comparing an output signal supplied from the data lines DL1 to DLm with a preset reference value. (Herein, an "on" state of a switch is a closed state and an "off" state is an open state.)

It is noted that while FIG. 1 illustrates the crack detector 605 in a configuration separate from those of the data driver 300 and the timing controller 400 in an alternative arrangement, at least a portion of the elements of the crack detector 605 may be included in the data driver 300 and/or the timing controller 400.

Each of the data lines DL1 to DLm may have a near end on a first side of the display panel 100 and a far end on a second, opposite side of the display panel 100. In an embodiment, each of the crack detection switches CSW may be connected to far ends of two data lines adjacent to each other at the second side of the display panel 100. For example, the crack detection switches CSW may be disposed at the opposite side of the data driver 300 with respect to the display panel 100.

In an embodiment, the number of the crack detection switches CSW may be one half of the number of the data lines. In this case, there may be "j" crack detection switches CSW1-CSWj, where j=m/2. Accordingly, a crack of the display panel 100 can be detected through all the data lines DL1 to DLm, and a crack position can also be detected.

Data lines (e.g., DL1 and DL2) connected to a crack detection switch CSW may be classified into an input data line DIL1 and an output data line DOL1. The input data line DIL1 may receive a crack detection signal for crack detection, and the output data line DOL1 may provide an output signal to the crack detection circuit 600.

The crack detection circuit 600 may determine whether a crack has occurred in the corresponding data lines DIL1 and DOL1 by analyzing the output signal. For instance, the existence of a crack may be determined based on a level of the output signal. The position of the crack may be determined by knowing which output data line DOLi is outputting the output signal at any given time. In an example, individual ones of the output signal switches 410 may be selectively closed to route an output signal from a corresponding output data line.

In a conventional display device, crack detection is performed by sensing a power voltage ELVDD or ELVSS or current from a power supply line connected to the display panel. An emission period and a non-emission period are distinguished, and crack detection driving is performed during the non-emission period by varying the power voltage ELVDD and/or the power voltage ELVSS. However, while such a driving method is applicable to a pixel structure that requires an emission control signal, it may be unsuitable for application to an external sensing pixel structure. In addition, in such a display device it may be difficult to check the position of a crack by sensing the power voltage or current from the power supply line. Moreover, crack detection is performed based on a load value of the entire display panel, which may result in low detection accuracy.

However, in the display device 1000 according to an embodiment of the present disclosure, conducting loops are generated using data line pairs, and crack detection in each of the conducting loops is performed, so that an accurate crack position can be checked. Further, a crack detection operation can be performed for a very short time interval within a vertical blank period in an external sensing pixel structure.

Figure 2:
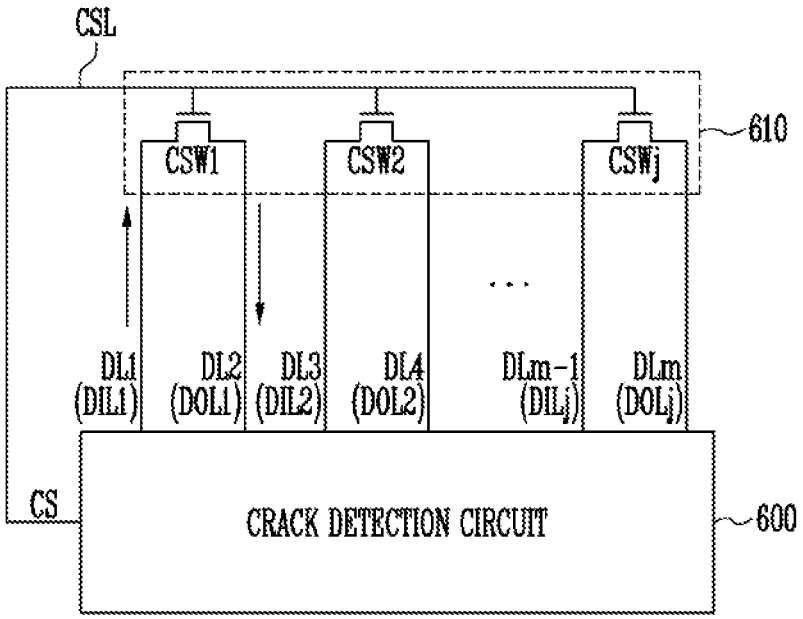
FIG. 2 is a diagram illustrating a crack detector according to an embodiment of the present disclosure.
Figure 3:
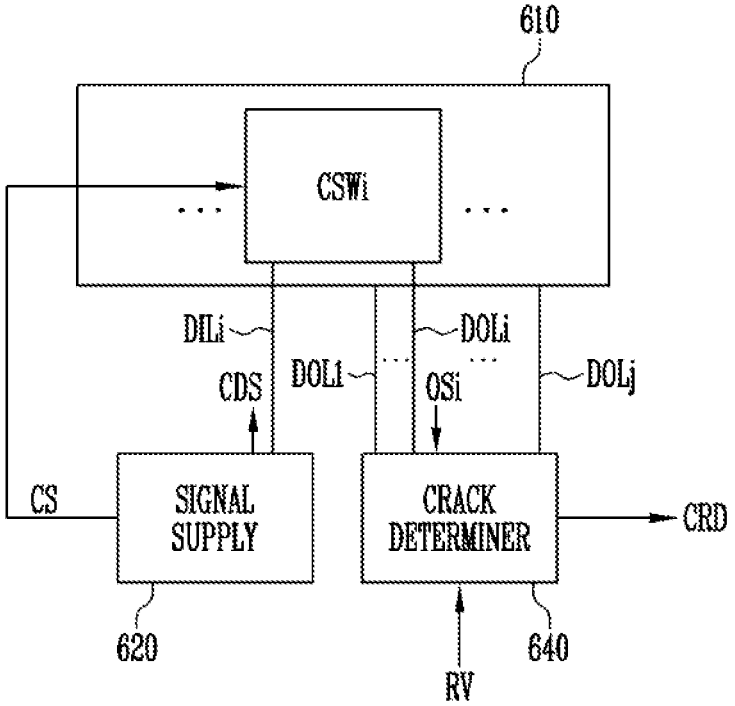
FIG. 3 is a block diagram illustrating an example of the crack detector of FIG. 2.

FIG. 2 is a diagram illustrating elements of a crack detector 605 according to an embodiment of the present disclosure. FIG. 3 is a block diagram illustrating an example of the crack detector of FIG. 2.

Referring to FIGS. 1 to 3, the crack detector 605 may include the switch set 610, a signal supply 620, and a crack determiner 640. (Crack detector 605 may also include switches 410, discussed later in connection with FIGS. 4 and 5.)

The switch set 610 may include a plurality of crack detection switches CSW1 to CSWj for connecting between data lines DL1 to DLm (j and m are natural numbers of 2 or more).

Each of the crack detection switches CSW1 to CSWj may be controlled to electrically connect and disconnect two different data lines. For example, each of the crack detection switches CSW1 to CSWj may be connected to far ends of adjacent data lines among the data lines DU to DLr, and the number of the crack detection switches CSW1 to CSWj may be one half of the number of the data lines DL1 to DLm.

In an embodiment, each of the crack detection switches CSW1 to CSWj may be configured with a Metal Oxide Semiconductor (MOS) transistor. As shown in FIG. 2, the crack detection switches CSW1 to CSWj may be implemented with an N-type MOS (NMOS) transistor. However, this is merely illustrative, and the crack detection switches CSW1 to CSWj are not limited thereto. For instance, P-type MOS (PMOS) transistors may be substituted.

The crack detection switches CSW1 to CSWj may be controlled by a detection control signal CS. For example, gate electrodes of the crack detection switches CSW1 to CSWj may be connected to a single detection control line CSL to be simultaneously turned on or turned off. In alternative switching schemes, the crack detection switches CSW1 to CSWj may be sequentially turned on, or only some of the crack detection switches CSW1 to CSWj may be turned on at a specific time.

Input data lines DIL1 to DILj and output data lines DOL1 to DOLj may be connected to opposite ends of the crack detection switches CSW1 to CSWj, respectively. (It is noted here that one "end" of a MOS transistor may be a source electrode, while the other end of the transistor may be a drain electrode.)

When the crack detection switches CSW1 to CSWj are turned on, m/2 detection loop paths may be formed. Accordingly, crack detection on all the data lines DL1 to DLm can be performed. For example, a predetermined test voltage or test current may be input through the input data lines DIL1 to DILj to be output to the crack determiner 640 through the output data lines DOL1 to DOLj. (Note that while a test voltage produces a current on the data line to which it is applied, and a test current is generated by a voltage, the manner of measuring the output signal from an output data line DOLi may differ depending on whether a test voltage or a test current is applied to the input line DILi)

The signal supply 620 may supply the detection control signal CS for controlling on/off of the crack detection switches CSW1 to CSWj to the switch set 610. The signal supply 620 may supply a crack detection signal CDS to the data lines DL1 to DLm, particularly, the input data lines DIL. FIG. 3 illustrates that the crack detection signal CDS may be applied to any input data line DILi and may be routed through a switch CSWi to an output data line DOL1. Here, the output data line DOLi may output an output signal OSi, derived from the crack detection signal CDS, to the crack determiner 640.

In an embodiment, the detection control signal CS may have a gate-on voltage in a vertical blank period. For example, the detection control signal CS may have the gate-on voltage during a time interval set in the range of 1 H-2 H periods, in the vertical blank period.

The crack detection signal CDS may correspond to a preset test voltage or a preset test current. When the crack detection switches CSW1 to CSWj are turned on, the crack detection signal CDS may be supplied to the input data lines DIL.

The crack determiner 640 may receive an output signal OS supplied from the data lines AL1 to DLm, particularly, the output data lines DOL. The crack determiner 640 may detect a crack of the display panel 100 by comparing the output signal OS and a preset reference value RV. For example, the crack determiner 640 may receive a voltage or waveform of the output signal OS received when about a 2 H period elapses after the detection control signal CS is supplied. The crack determiner 640 may include a hardware component such as a comparator circuit.

In an embodiment, the crack determiner 640 may include a plurality of comparators corresponding to the output data lines DOL. Each comparator circuit compares an output signal OS on a respective output data line DOL with the reference value RV.

In an embodiment, the crack determiner 640 may include a single comparator (or comparators having less number than the output data lines DOL) to compare the output signal OS with the reference value. The comparator may receive output signals from each of the output data lines at different timings. In this case, the crack determiner 640 may further include timing buffers or switches (output signal switches) connected to each of the output data lines DOL to control input timings of the output signals supplied to the comparator. Or, the crack determiner 640 may further include a memory for storing data of the output signals and sequentially outputting the output signals to the comparator. The crack detection signal CDS may be changed by line resistance of the data line and the crack detection switch, and other circuit factors. Therefore, a voltage drop and current leakage may occur due to a factor other than the existence of a crack. Accordingly, a difference in signal level, within a predetermined range based on an expected variation, may occur between the crack detection signal CDS and the output signal OS even when there is no crack. Accordingly, the reference value RV may be set to a value just beyond an offset range obtained by reflecting these factors.

FIG. 3 illustrates an example where each of the output data lines DOL1-DOLj are directly connected to the crack determiner 640. In one embodiment, the crack determiner 640 comprises j separate comparator circuits arranged in parallel, where each comparator circuit compares an output signal OS on a respective output data line DOL with the reference value RV. In this manner, the position of any detected crack may be identified. For example if an output signal OS1 on an output data line DOL1 has a signal level indicative of a crack, as measured by the respective comparator circuit within comparator 640 connected to the output data line DOL1, it may be assumed that the crack has occurred at a location along the output data line DOL1 or the input data line DIL1.

In an alternative configuration, the crack determiner 640 has only a single comparator circuit that compares one output signal OS at a time with the reference value RV. In this case, one switch 410 (seen in FIGS. 4 and 5) may be included between each output data line DOL and the comparator circuit. That is, there may be j switches 410 connected between j respective output data lines DOL1-DOLj and the comparator circuit, and only one of the j switches 410 is closed at any given time to provide the output signal OS from the corresponding output data line DOL to the comparator circuit.

In an embodiment, when the crack detection signal CDS corresponds to the test voltage, the reference value RV may correspond to a range obtained by applying a preset voltage drop offset to the test voltage. In other words, the reference value RV may be set to a level just beyond a range of the output signal expected when no crack is present in a corresponding data line pair. (Here, the corresponding data line pair is the data output line DOL and the data input line DIL connected to that data output line through a crack detection switch CSW.) When the output signal OS has a voltage level out of the range of the reference value RV (e.g., below the reference value RV), the comparator 640 may determine that a crack has occurred in corresponding data lines DIL and DOL. When the output signal OS has a level below the reference value RV (or, out of a range of the reference value RV), the comparator 640 may output crack data CRD indicative of the presence of a crack. The crack data CRD may include crack occurrence information and crack position information.

In an embodiment, a warning signal or warning image may be output from the display device 1000 in response to the crack data CRD. Alternatively, power of the display device 1000 may be automatically switched off in response to the crack data CRD.

In an embodiment, the crack data CRD may be stored in a predetermined memory. For example, when the crack data CRD is accumulated to exceed a preset threshold value, a failure occurrence image may be output, or the power of the display device 1000 may be switched off.

When the output signal OS is within an expected range of a condition where no crack is present, e.g., the output signal OS has a voltage within a range of the reference value RV, the comparator 640 may determine that the state of the display panel 100 is normal. Accordingly, an image of a next frame can be normally displayed.

In an embodiment, when the crack detection signal CDS corresponds to a test current, the reference value RV may correspond to a current level at a boundary of, or just beyond, a preset line resistance range. Here, the reference value RV may be referred to as a threshold current level. The line resistance range may be a normal resistance range obtained by considering one or more factors such as the current leakage. If a crack exists in the corresponding data line pair from which the output signal is provided, an open circuit may exist in either the input data line or the output data line, and the resulting current may be low or near zero. Accordingly, the resulting current may be beyond the threshold current level by being below the reference value RV, and correspond to a resistance outside the normal resistance range.

When the output signal OS is beyond the threshold current level, the crack determiner 640 may output crack data CRD. The crack data CRD may include crack occurrence information and crack position information.

As described above, in the display device 1000 and the crack detector 605 included therein according to the embodiment of the present disclosure, whether a crack of the display panel 100 has occurred and a crack position can be relatively accurately detected with a relatively simple configuration, using all the data lines DL1 to DLm. Further, crack detection can be performed on the entire area of the display panel 100 for a short time interval within the vertical blank period. Thus, crack detection accuracy can be enhanced, and product reliability can be considerably improved.

Figure 4:
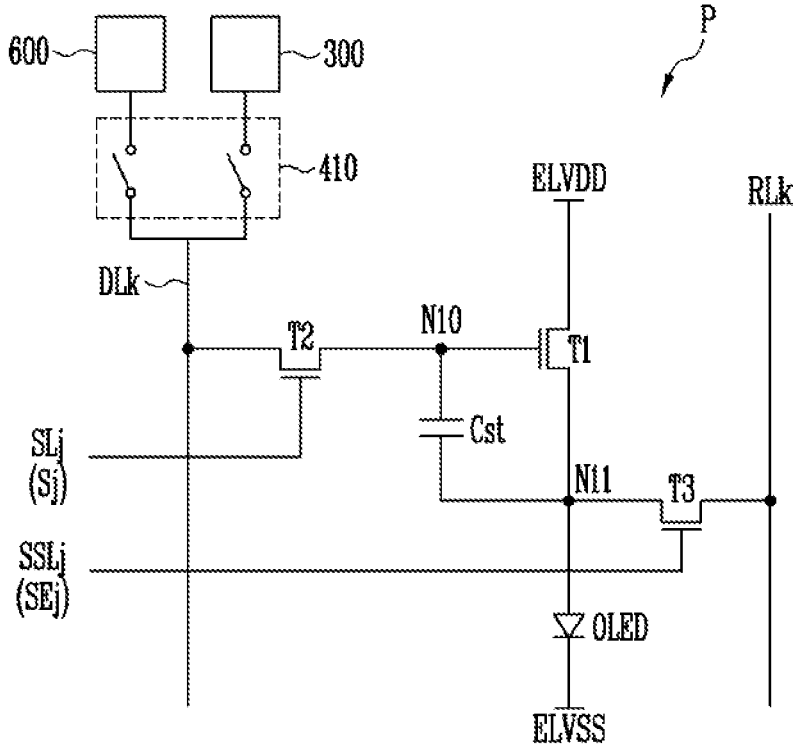
FIG. 4 is a diagram illustrating an example of a pixel and a data line, which are included in the display device of FIG. 1.

FIG. 4 is a diagram illustrating an example of a pixel and a data line, which may be included in the display device of FIG. 1.

The pixel P of FIG. 4 is a pixel connected to a jth scan line SLj and a kth data line DLk (j and k are natural numbers).

Referring to FIGS. 1 and 4, the pixel P may include an organic light emitting diode OLED, a first transistor (driving transistor) T1, a second transistor T2, a third transistor T3, and a storage capacitor Cst.

An anode electrode of the organic light emitting diode OLED may be connected to a second electrode of the first transistor T1, and a cathode electrode of the organic light emitting diode OLED may be connected to a second driving power source ELVSS. The organic light emitting diode OLED generates light with a predetermined luminance corresponding to an amount of current supplied from the first transistor T1.

A first electrode of the first transistor T1 may be connected to a first driving power source ELVDD, and the second electrode of the first transistor T1 may be connected to the anode electrode of the organic light emitting diode OLED. A gate electrode of the first transistor T1 may be connected to a tenth node N10. The first transistor T1 controls an amount of current flowing through the organic light emitting diode OLED, corresponding to a voltage of the tenth node N10.

A first electrode of the second transistor T2 may be connected to the data line DLk, and a second electrode of the second transistor T2 may be connected to the tenth node N10. A gate electrode of the second transistor T2 may be connected to the scan line SL j. The second transistor T2 may be turned on when a scan signal is supplied to the scan line SLj, to transfer a data voltage from the data line DLk to the tenth node N10.

The third transistor T3 may be connected between a read-out line RLk and the first electrode (i.e., an eleventh node N11) of the first transistor T1. The third transistor T3 may transfer a sensing current to the read-out line RLk in response to a sensing control signal SEj transferred through a sensing control line SSLj. The sensing current may be used to calculate a mobility of the first transistor T1 and a variation in threshold voltage of the first transistor T1. Mobility and threshold voltage information may be calculated according to a relationship between the sensing current and a voltage for sensing. In an embodiment, the sensing current may be converted in a is voltage form to be used in a compensation operation of a data voltage.

The storage capacitor Cst may be connected between the tenth node N10 and the anode electrode of the organic light emitting diode OLED.

The data line DLk may be an input data line or an output data line. In an embodiment, the data line DLk may be connected to the data driver 300 in a display period. Therefore, a data voltage corresponding to a grayscale may be supplied to the data line DLk. Also, the data line DLk may be connected to the data driver 300 in a sensing period (e.g., a threshold voltage sensing period, a mobility sensing period, or an organic light emitting diode sensing period) except the display period.

In an embodiment, switches may be respectively connected to both ends of at least one data line DLk. For example, one switch CSW may be a switch for connecting between adjacent data lines, and the other switch 410 may be a switch for connecting the data line DLk to the data driver 300 and/or the crack detection circuit 600.

In an embodiment, the data line DLk may be connected to the crack detection circuit 600 during a partial period of a blank period. For example, the data line DLk and the crack detection circuit 600 may be electrically connected to each other during a crack detection period included in the blank period. During this time, the connection between the data line DLk and the data driver 300 may be cut off.

When the data line DLk is the input data line, a crack detection signal CDS may be supplied to the data line DLk. For example, the data line DLk may be connected to the signal supply of the crack detector 605.

When the data line DLk is the output data line, the data line DLk may transfer an output signal to the crack detection circuit 600. For example, the data line DLk may be connected to the crack determiner of the crack detection circuit 600.

As described above, all the data lines may be connected to the data driver 300 in the display period and the sensing period, and be connected to the crack detection circuit 600 in the crack detection period.

As mentioned earlier, in an embodiment, the crack determiner 640 may have only a single comparator circuit that compares one output signal OS at a time with the reference value RV. In this case, one switch 410 (seen in FIGS. 4 and 5) may be included between each output data line DOL and the crack determiner 640. That is, there may be j switches 410 connected between j respective output data lines DOL1-DOLj and the crack determiner 640, and only one the j switches 410 is closed at any given time to provide the output signal OS from the corresponding output data line DOL to the crack determiner 640. In one example, output signals from different respective output data lines DOL are received by the crack determiner 640 during a single frame. In another example, the output signals OS are provided to the crack determiner 640 during different frames. In this case, for example, through selective on/off switching of the switches 410, one output signal OSi from an output data line DOLi is received by crack determiner 640 during the testing period of a first frame due to a first switch 410 connected to the output data line DOLi being switched on. At the same time during the first frame, no output signal is received from another output data line DOLk due to a second switch 410 connected to the output data line DOLk being switched off. In another frame, the opposite switching condition may occur so as to measure the output signal from the output data line DOLk but not from DOLi.

In an embodiment, the crack determiner 640 may have a plurality of comparator circuits each compares one output signal OS at a time with the reference value RV. In this case, the j switches 410 are closed at any given time to provide the output signals from the corresponding output data lines to the comparator circuits. In one example, output signals from different respective output data lines DOL are received by the crack determiner 640 during a frame, e.g., a partial period of the blank period.

Figure 5:
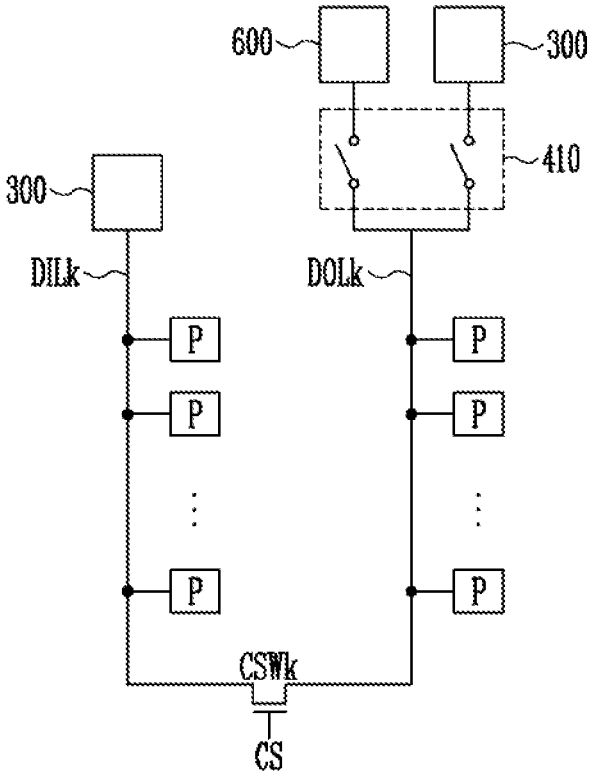
FIG. 5 is a diagram illustrating an example of a connection relationship of data lines included in the display device of FIG. 1.

FIG. 5 is a diagram illustrating an example of a connection relationship of data lines included in the display device 1000 of FIG. 1.

Referring to FIGS. 1, 3, 4, and 5, an input data line DILk and an output data line DOLk may be connected to each other through a crack detection switch CSWk, and form a conducting loop.

In an embodiment, the input data line DILk may be connected to the data driver 300. The data driver 300 may output a data voltage corresponding to a grayscale in a display period. The data driver 300 may output a crack detection signal in a crack detection period included in a partial period of the vertical blank period. That is, the input data line DILk may receive the data voltage in the display period, and receive the crack detection signal in the crack detection period.

In an embodiment, the data driver 300 may output a preset sensing voltage corresponding to a sensing purpose during a sensing period.

In an embodiment, the output data line DOLk may be selectively connected to the data driver 300 and the crack detection circuit 600. The output data line DOLk may be connected to the data driver 300 in the display period to receive a data voltage. The output data line DOLk may be connected to the crack detection circuit 600 in the crack detection period of the vertical blank period to provide an output signal to the crack detection circuit 600.

That is, a crack detection switch CSW may be connected to one end of the output data line DOLk, and a switch for connecting the output data line DOLk to the data driver 300 and/or the crack detector 605 may be connected to the other end of the output data line DOLk.

As described above, the input data line DILk and the output data line DOLk may have different connection relationships. Thus, the number of switches and lines for connecting the data driver 300 and the crack detector 605 to a data line can be decreased. Further, the data driver 300 can selectively output the data voltage, the sensing voltage, and the crack detection signal.

Figure 6:
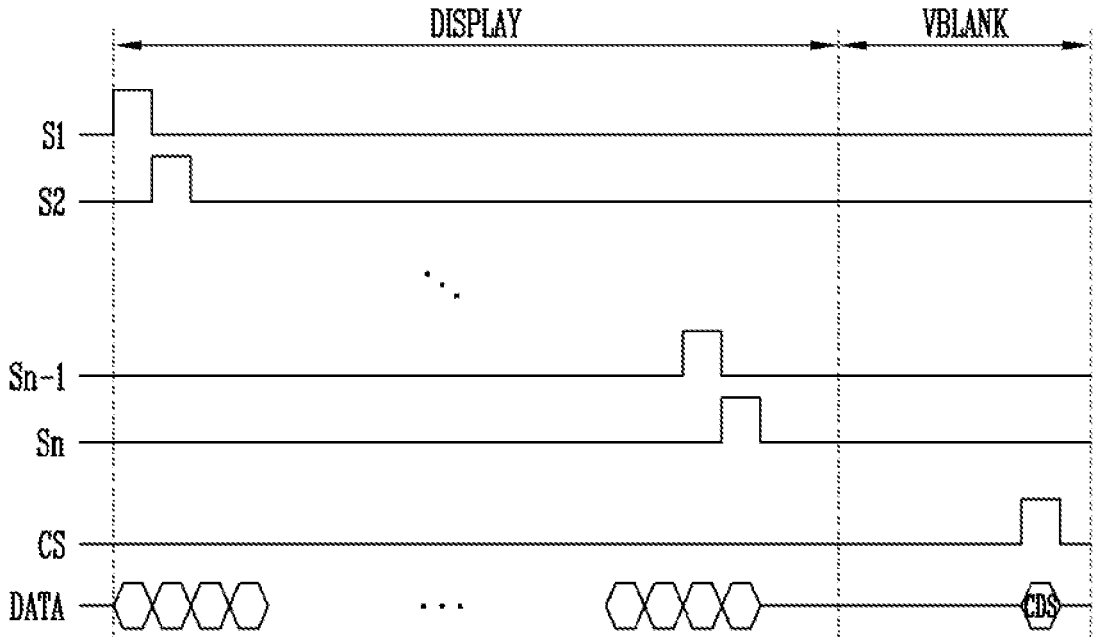
FIG. 6 is a diagram illustrating an example of an operation of the display device of FIG. 1.

FIG. 6 is a diagram illustrating an example of an operation of the display device of FIG. 1.

Referring to FIGS. 1, 4, 5, and 6, the display device 1000 may sequentially write a data voltage along pixel lines, and sequentially emit light along the pixel lines.

In an embodiment, the display device 1000 may include the pixel P of FIG. 4. Scan signals S1 to Sn may be sequentially written to the pixel lines during the display period, and the pixel lines may sequentially emit light with a grayscale corresponding to the written data voltage.

A partial period of the vertical blank period may be defined as a crack detection period. The detection control signal CS may have a gate-on voltage during the crack detection period. Accordingly, the crack detection switch CSW can be turned on. In an embodiment, the crack detection period may be preset having a duration in the range of about a 1 H period to about a 2 H period. For example, if the display device 1000 is driven at 120 Hz, the crack detection period may be very short at about 8 μs or less.

In an embodiment, when the data line has the connection structure of FIG. 5, the data driver 300 may output a voltage corresponding to the crack detection signal CDS in the crack detection period. The crack detection signal CDS may be simultaneously supplied to all the input data lines DIL.

In an embodiment, when the data line has the connection structure of FIG. 4, the signal supply included in the crack detection circuit 600 may output the crack detection signal CDS in the crack detection period.

Meanwhile, in an embodiment, mobility sensing may be performed on some of the pixel lines in a partial period of the vertical blank period. Since the crack detection period may correspond to a very short time interval, the crack detection period and the mobility sensing period do not overlap with each other.

Figure 7:
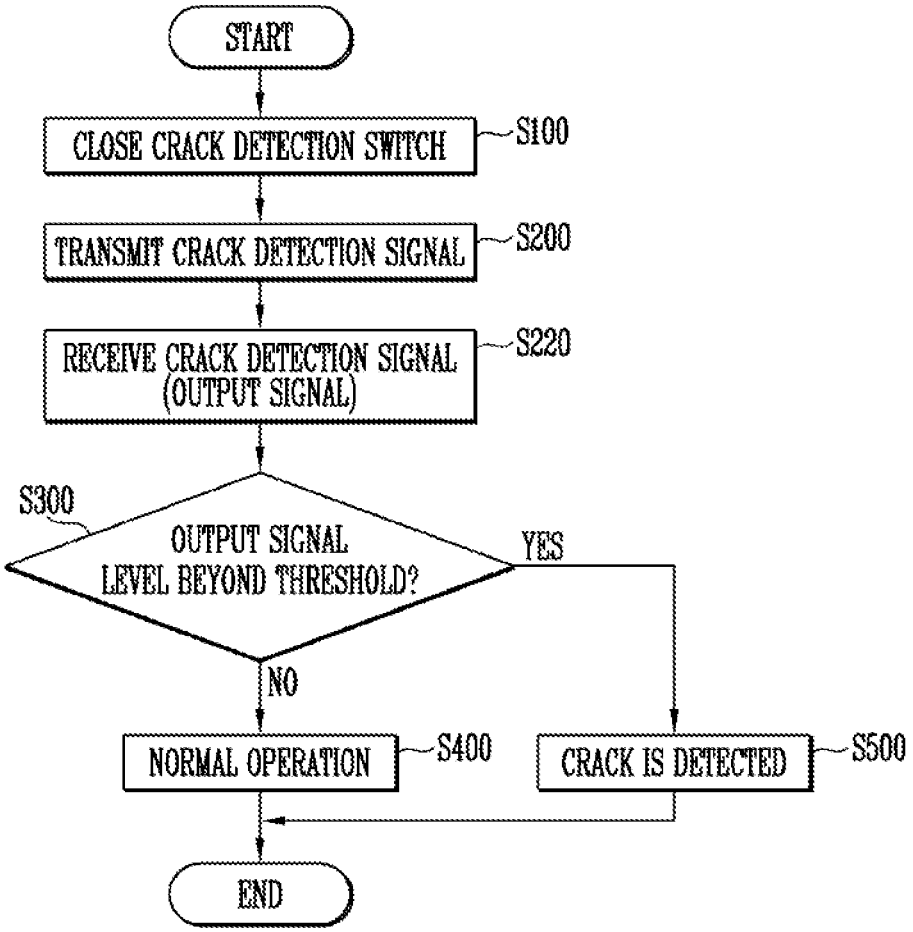
FIG. 7 is a flowchart illustrating a method for driving the display device according to an embodiment of the present disclosure.

FIG. 7 is a flowchart illustrating a method for driving the display device according to an embodiment of the present disclosure. The method may include turning on a crack detection switch for electrically connecting an input data line and an output data line during a vertical blank period (S100), and supplying a crack detection signal to the input data line (S200). The crack detection signal may be received (S220) by a crack determiner (including at least one comparator) as an output signal supplied from the output data line. The method may then determine whether the level of the output signal is beyond a threshold (S300) (e.g., where the threshold is set at the edge of, or just beyond, a range expected for normal operation of the corresponding data line pair without the existence of a crack). An image of a next frame may be displayed when the output signal level is not beyond the threshold (S400). Crack data may be output when the output signal level is beyond the threshold (S500).

With continued reference to FIG. 7, the crack detection switch for electrically connecting the input data line and the output data line may be turned on during the vertical blank period (S100). The period in which the crack detection switch is turned on may correspond to a crack detection period. For example, the crack detection period may have a duration in the is range of about a 1 H period to about a 2 period.

In an embodiment, one half of all the data lines included in the display device may be input data lines, and the other half may be output data lines. Accordingly, the number of crack detection switches may be one half of the number of the data lines.

In an embodiment, when the crack detection switch is turned on, a crack detection signal may be supplied to the input data line, and an output signal from the output data line may be output (S200, S220). In an embodiment, the crack detection signal may correspond to a preset test current.

Subsequently, a comparison of the output signal to the threshold value (a present reference value) may be compared (S300). The reference value may be an offset value obtained by considering a general voltage drop or voltage rise factor such as a line resistance.

When the output signal, which is derived from the crack detection signal, is not beyond the threshold, it may be determined that no crack has occurred in the display panel. Accordingly, the display device can normally operate. For example, when the output signal voltage is not smaller than a voltage corresponding to the reference value, an image of a next frame may be normally displayed (S400).

When the output signal level is below the reference value, it may be determined that a crack has occurred in the display panel. Accordingly, crack data may be output (S500). The crack data may include crack occurrence information and crack position information.

In an embodiment, a warning signal or warning image may be output from the display device in response to the crack data. Alternatively, power of the display device may be off in response to the crack data.

In an embodiment, the crack data may be stored in a predetermined memory. The crack data may unintentionally occur due to a sudden voltage fluctuation caused by an external factor such as static electricity. In order to minimize erroneous determination, it may be determined that a crack has finally occurred at a corresponding position, when the crack data s accumulated to exceed a preset threshold value.

When it is determined that the crack has occurred, a failure occurrence image (crack sensing image) may be output, or the power of the display device may be off.

Figure 8:
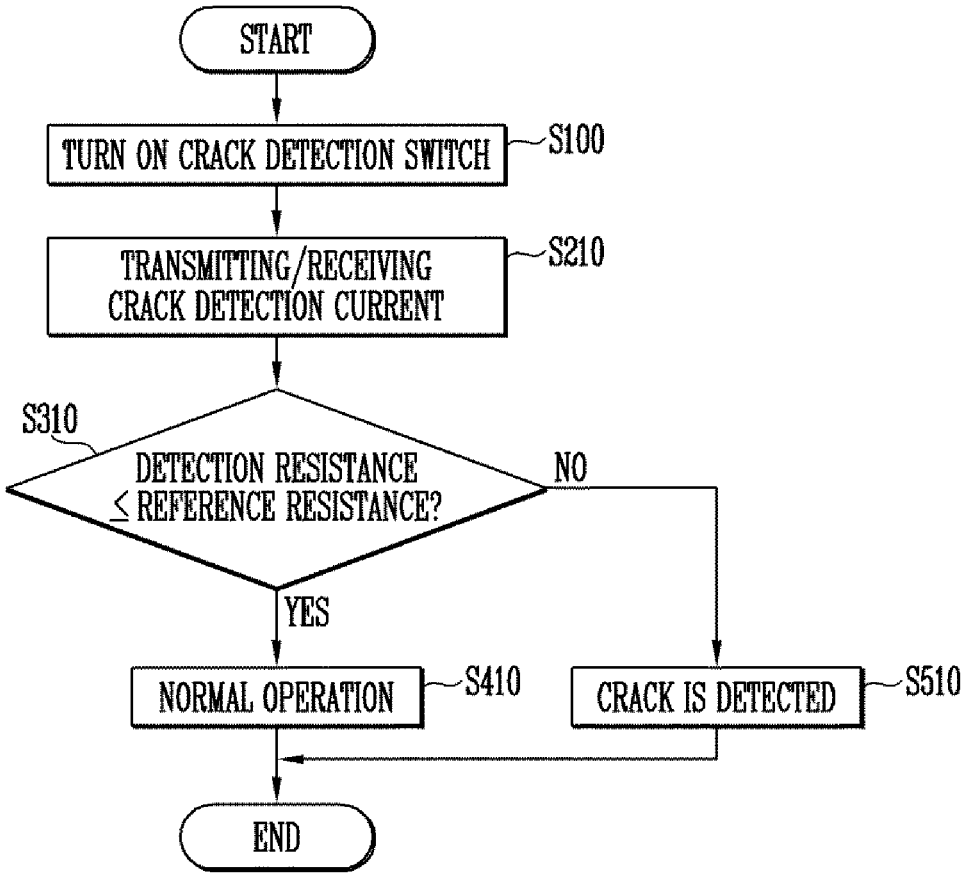
FIG. 8 is a flowchart illustrating a method for driving the display device, in which a test current is used to test for cracks.

FIG. 8 is a flowchart illustrating a method for driving the display device 1000 according to an embodiment of the present disclosure, in which a test current is used to test for cracks. As shown in FIG. 8, a crack detection current may be supplied to the input data line, and an output signal (output current) may be output from the output data line (S210). In an embodiment, the crack detection current may correspond to a preset test current.

A detection resistance may be calculated from the output current, corresponding to the crack detection current. As shown in FIG. 8, the detection resistance and a preset reference resistance may be compared (S310).

When the detection resistance is equal to or smaller than the reference resistance, it may be determined that any crack has not occurred in the display panel. Accordingly, the display device may normally operate. For example, when the detection resistance is equal to or smaller than the reference resistance, an image of a next frame may be normally displayed (S410).

When the detection resistance exceeds the reference resistance, it may be determined that a crack has occurred in the display panel. Accordingly, crack data may be output (S500).

The methods of FIGS. 7 and 8 have been described with reference to FIGS. 1 to 6, and therefore, their overlapping descriptions will be omitted.

As described above, in the display device and the method for driving the same according to the embodiment of the present disclosure, a determination of whether a crack of the display panel has occurred, and if so, a crack position, can be accurately detected with a relatively simple configuration, using all the data lines. Thus, crack detection accuracy can be enhanced, and product reliability can be considerably improved.

The inventive concept can be applied to any suitable electronic device including a display device. For example, the present disclosure can be applied to HMD devices, TVs, digital TVs, 3D TVs, PCs, home appliances, notebook computers, tablet computers, mobile phones, smart phones, PDAs, PMPs, digital cameras, music players, portable game consoles, navigation systems, wearable displays, and the like.

In a crack detector, a display device including the same, and a method for driving the display device according to the inventive concept, a determination of whether a crack of the display panel has occurred, and if so, a crack position, can be accurately detected with a relatively simple configuration, using a voltage or current applied to all the data lines. Further, crack detection can be performed on the entire area of the display panel for a short time interval of the vertical blank period. Thus, crack detection accuracy can be enhanced, and product reliability can be considerably improved Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A crack detector comprising:

a plurality of crack detection switches for connecting/disconnecting data lines of a display panel to one another;

a signal supply configured to supply a detection control signal for controlling closing/opening of the crack detection switches, and to supply a crack detection signal to a first data line of the data lines; and a crack determiner configured to determine a crack of the display panel by comparing an output signal supplied from a second data line of the data lines connected to the first data line through a first one of the crack detection switches, with a preset reference value, wherein a number of the crack detection switches is one half of a number of the data lines of the display panel.

2. The crack detector of claim 1, wherein each of the crack detection switches electrically connects and disconnects two data lines to one another.

3. The crack detector of claim 2, wherein each of the data lines has a near end and a far end, and each of the crack detection switches is connected to far ends of the two data lines, wherein the two data lines are adjacent to each other.

4. The crack detector of claim 1, wherein the detection control signal causes each of the crack detection switches to substantially simultaneously close and thereby electrically connect input and output data lines of a respective pair of the data lines.

5. The crack detector of claim 1, wherein the crack detection signal corresponds to a preset test voltage, wherein the reference value is a voltage beyond an expected range of the output signal for a non-cracked condition, wherein an edge of the range is a preset voltage offset from the test voltage.

6. The crack detector of claim 5, wherein the crack determiner outputs crack data indicative of the presence of a crack affecting the first and second data lines when the output signal is out of the range of the reference value.

7. The crack detector of claim 1, wherein the crack detection signal corresponds to a preset test current, wherein the reference value corresponds to a preset line resistance range.

8. The crack detector of claim 7, wherein the crack determiner outputs crack data indicative of the presence of a crack affecting the first and second data lines when a resistance value calculated from the output signal is outside the line resistance range.

9. A display device comprising:

a display panel including a plurality of pixels connected to a plurality of scan lines and a plurality of data lines;

a scan driver configured to supply a scan signal to each of the scan lines;

a data driver configured to supply a data signal to each of the data lines; and a crack detector configured to detect a crack of the display panel, based on a crack detection signal supplied to the data lines, wherein the crack detector includes:

a plurality of crack detection switches for connecting/disconnecting the data lines to one another;

a signal supply configured to supply a detection control signal for controlling closing/opening of the crack detection switches; and a crack determiner configured to determine a crack of the display panel and a position of the crack among the plurality of data lines by comparing an output signal supplied from the data lines with a preset reference value, wherein a number of the crack detection switches is one half of a number of the data lines.

10. The display device of claim 9, wherein each of the data lines has a near end connected to the data driver, and a far end opposite the near end, and each of the crack detection switches is connected to far ends of two data lines adjacent to each other at one side of the display panel.

11. The display device of claim 9, wherein the crack detection switches are closed during a crack detection period included in a vertical blank period.

12. The display device of claim 11, wherein the crack detection switches are substantially simultaneously closed during a time interval in the range of about 1H to 2H, where H is a horizontal period currently used by the display device to display a line of a frame.

13. The display device of claim 9, wherein the data lines include:

input data lines connected to the signal supply to receive a crack detection signal for crack detection; and output data lines connected to the crack determiner to provide the output signal to the crack determiner.

14. The display device of claim 13, wherein the crack detection switches respectively connect the input data lines to the output data lines.

15. The display device of claim 13, wherein the input data lines and the output data lines are connected to the data driver during a display period, and are connected to the crack detector during a vertical blank period.

16. The display device of claim 9, wherein the data driver outputs a crack detection signal for crack detection during a partial period of a vertical blank period.

17. The display device of claim 16, wherein the data lines include:

input data lines connected to the data driver, the input data lines each receiving a respective data voltage during a display period, the input data lines receiving the crack detection signal during the vertical blank period; and output data lines connected to the data driver during the display period to receive a respective data voltage, and connected to the crack determiner in the vertical blank period to provide the output signal to the crack determiner.

18. A method for driving a display device, the method comprising:

closing a crack detection switch to thereby electrically connect an input data line and an output data line, during a crack detection period included in a vertical blank period;

when the input and output data lines are electrically connected, supplying a crack detection signal to the input data line and receiving an output signal supplied from the output data line;

if a level of the output signal is within a preset range, displaying an image of a next frame; and if the level of the output signal is outside the preset range, outputting crack data indicative of a crack affecting the input and output data lines, wherein:

the crack detection switch is a first crack detection switch, the input data line is a first data line, the output data line is a second data line adjacent to the first data line, and the display device further comprises a third data line and a fourth data line adjacent to the third data line and a second crack detection switch connected between the third data line and the fourth data line, said closing the crack detection switch comprises closing the first crack detection switch during a first frame, and the method further comprising:

opening the second crack detection switch during the first frame while the first crack detection switch is closed; and closing the second crack detection switch during a second frame succeeding or preceding the first frame, and opening the first crack detection switch during the second frame while the second crack detection switch is closed.

19. The method of claim 18, further comprising outputting a warning image in response to the crack data.

* * * * *